US010601202B2

(12) United States Patent
Fujimura et al.

(10) Patent No.: US 10,601,202 B2
(45) Date of Patent: Mar. 24, 2020

(54) SPARK PLUG

(71) Applicant: NGK SPARK PLUG CO., LTD., Nagoya-shi, Aichi (JP)

(72) Inventors: Kengo Fujimura, Nagoya (JP); Kimihiro Nishizono, Nagoya (JP); Hiroki Ota, Nagoya (JP)

(73) Assignee: NGK SPARK PLUG CO., LTD., Nagoya-shi, Aichi (JP)

( * ) Notice: Subject to any disclaimer, the term of this patent is extended or adjusted under 35 U.S.C. 154(b) by 0 days.

(21) Appl. No.: 16/472,275

(22) PCT Filed: Sep. 5, 2017

(86) PCT No.: PCT/JP2017/031948

§ 371 (c)(1),
(2) Date: Jun. 21, 2019

(87) PCT Pub. No.: WO2018/123146

PCT Pub. Date: Jul. 5, 2018

(65) Prior Publication Data

US 2019/0326733 A1 Oct. 24, 2019

(30) Foreign Application Priority Data

Dec. 27, 2016 (JP) ..... 2016-253243

(51) Int. Cl.
*H01T 13/20* (2006.01)
*H01T 13/02* (2006.01)

(52) U.S. Cl.
CPC ..... *H01T 13/20* (2013.01); *H01T 13/02* (2013.01)

(58) Field of Classification Search
CPC ..... H01T 13/20; H01T 13/02
USPC ..... 313/139–143, 118
See application file for complete search history.

(56) References Cited

U.S. PATENT DOCUMENTS 8,395,307 B2 3/2013 Suzuki et al.

FOREIGN PATENT DOCUMENTS

| | | | |
|---|---|---|---|
| JP | 2001-176637 | A | 6/2001 |
| JP | 2014-107084 | A | 6/2014 |
| WO | WO-2010-082409 | A1 | 7/2010 |

OTHER PUBLICATIONS

International Search Report from corresponding International Patent Application No. PCT/JP2017/031948, dated Nov. 14, 2017.

*Primary Examiner* — Joseph L Williams
(74) *Attorney, Agent, or Firm* — Kusner & Jaffe

(57) ABSTRACT

A spark plug enabling suppression of reduction in the strength of an insulator. In the spark plug, a rear end portion of an engagement portion formed on an outer peripheral surface of a tubular insulator extending along an axial line from a front side to a rear side, is engaged with a to-be-engaged portion of a tubular metal shell disposed on the outer peripheral surface of the insulator. The insulator is made from ceramic such as alumina. On at least a part of the outer peripheral surface of the insulator, a projected and recessed portion is formed on the front side relative to the engagement portion so as to helically extend in a circumferential direction of the insulator.

2 Claims, 9 Drawing Sheets

SPARK PLUG

FIELD OF THE INVENTION

The present invention relates to a spark plug, and particularly to a spark plug enabling suppression of reduction in the strength of an insulator.

BACKGROUND OF THE INVENTION

In a spark plug, a metal shell mounted to an engine holds an insulator made from ceramic such as alumina (Japanese Patent Application Laid-Open (kokai) No. 2014-107084). If moisture (condensate or the like) or fuel (hereinafter, referred to as "moisture or the like") is put on the surface of the insulator of the spark plug mounted to the engine and the moisture or the like reacts with a glass phase at a grain boundary of the ceramic, there is a risk that the glass phase is degraded and the strength of the insulator is reduced.

In the above-described conventional technique, there is a need to suppress reduction in the strength of the insulator due to reaction between the moisture or the like and the glass phase.

The present invention has been conceived to address the above-described need, and an object of the present invention is to provide a spark plug enabling suppression of reduction in the strength of an insulator.

SUMMARY OF THE INVENTION

In accordance with the present invention, there is provided a spark plug wherein, a rear end portion of an engagement portion formed on an outer peripheral surface of a tubular insulator extending along an axial line from a front side to a rear side, is engaged with a to-be-engaged portion of a tubular metal shell disposed on the outer peripheral surface of the insulator. On at least a part of the outer peripheral surface of the insulator, a projected and recessed portion is formed on the front side relative to the engagement portion so as to helically extend in a circumferential direction of the insulator.

In accordance with a first aspect of the present invention, there is provided a spark plug as described above wherein, since the helical projected and recessed portion is formed on the outer peripheral surface of the insulator, moisture or the like put on the insulator can be thinly spread along the projected and recessed portion. The moisture or the like thinly spread on the outer peripheral surface of the insulator can be made easy to vaporize before the moisture or the like reacts with a glass phase at a grain boundary of ceramic, whereby an effect of suppressing reduction in the strength of the insulator due to degradation of the glass phase can be obtained.

In accordance with a second aspect of the present invention, there is provided a spark plug as described above wherein, in the projected and recessed portion, when amplitudes f(n) of frequencies n within 1 to 300 Hz are obtained by performing Fourier transform on a profile curve, of an actual surface of the outer peripheral surface, that appears on a cross section of the insulator including the axial line, and peaks are defined as a first peak, a second peak, a third peak, and a fourth peak in descending order of an absolute value of f(n+1)−f(n) (however, two or more peaks thereamong that are present within ±2 Hz are regarded as one peak), the first peak is present within 20 to 300 Hz, and two or more peaks among the first peak, the second peak, the third peak, and the fourth peak are present within 30 to 300 Hz. Three or more peaks among the first peak, the second peak, the third peak, and the fourth peak are not present within 1 to 20 Hz. Since the projected and recessed portion can be made cyclic, an effect of reducing variation in the contour of the outer peripheral surface of the insulator can be obtained in addition to the effect in the first aspect.

DETAILED DESCRIPTION OF THE INVENTION

Figure 1:
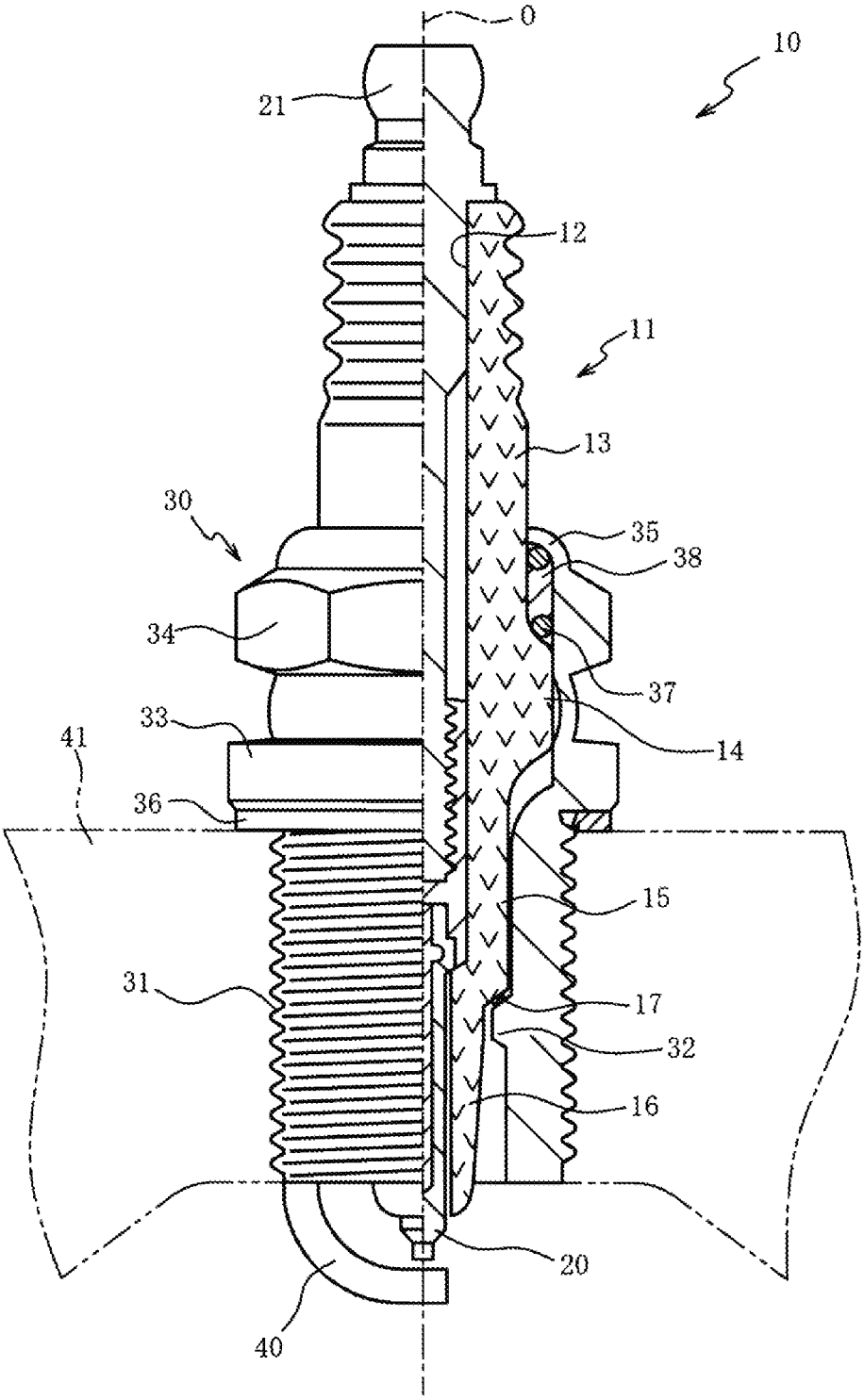
FIG. 1 is a half sectional view of a spark plug according to one embodiment of the present invention.

Hereinafter, a preferred embodiment of the present invention will be described with reference to the accompanying drawings. FIG. 1 is a half sectional view of a spark plug 10 according to one embodiment of the present invention. In FIG. 1, the lower side of the drawing sheet is referred to as a front side of the spark plug 10, and the upper side of the drawing sheet is referred to as a rear side of the spark plug 10. The spark plug 10 includes an insulator 11 and a metal shell 30.

The insulator 11 is a tubular member formed from ceramic such as alumina having excellent mechanical property and insulation property at high temperature. The insulator 11 has an axial hole 12 formed so as to penetrate therethrough along an axial line O. The insulator 11 has a first portion 13, an engagement portion 14, a second portion 15, and a third portion 16 which are contiguous to each other along the axial line O from the rear side to the front side.

The first portion 13 is a cylindrical portion on the rear side of the insulator 11. The engagement portion 14 is an annular portion that has an outer peripheral edge having a larger diameter than the first portion 13. The second portion 15 is a cylindrical portion having a smaller diameter than the first portion 13 and the engagement portion 14. The third portion 16 is a cylindrical portion having a smaller diameter than the second portion 15. The insulator 11 has a diameter reduction portion 17 which is formed at a border between the second portion 15 and the third portion 16 such that the diameter of the outer periphery of the diameter reduction portion 17 is reduced toward the front side. A center electrode 20 is disposed in the axial hole 12 at a portion on the inner side of the front end of the second portion 15 and the third portion 16.

The center electrode 20 is a rod-like member extending along the axial line O, and is obtained by coating, with nickel or a nickel-based alloy, a core material made from copper or a core material containing copper as a main component. The center electrode 20 is held by the insulator 11, and has a front end exposed from the axial hole 12.

A metal terminal 21 is a rod-like member to which a high-voltage cable (not shown) is to be connected, and is formed from a conductive metal material (e.g., low-carbon steel). The metal terminal 21 is fixed to the rear end of the insulator 11 in a state where the front side thereof is press-fitted in the axial hole 12. The metal terminal 21 is electrically connected to the center electrode 20 in the axial hole 12. The metal shell 30 is fixed to the front side of the outer periphery of the insulator 11 so as to be apart from the metal terminal 21 in the direction of the axial line O.

The metal shell 30 is a substantially cylindrical member formed from a conductive metal material (e.g., low-carbon steel). The metal shell 30 has a screw portion 31 formed on the front side of the outer peripheral surface thereof. The screw portion 31 is connected to a screw hole of an engine 41 so that the metal shell 30 is mounted to the engine 41. The metal shell 30 has a ledge portion 32, which is formed on the inner periphery on the radially inner side of the screw portion 31 so as to project radially inward.

The metal shell 30 has an annular seat portion 33, which is located rearward of the screw portion 31 so as to project radially outward in a flange shape. A gasket 36 for preventing combustion gas from leaking from the screw hole of the engine 41, is disposed between the seat portion 33 and the screw portion 31. A tool engagement portion 34 with which a tool such as a wrench is to be engaged is disposed on the rear side of the metal shell 30 relative to the seat portion 33. The screw portion 31 is screwed into the screw hole of the engine 41 by means of a tool that is engaged with the tool engagement portion 34.

The metal shell 30 has a to-be-engaged portion 35 contiguous to the rear end of the tool engagement portion 34. The to-be-engaged portion 35 is a portion formed as a result of the rear end edge of the metal shell 30 being bent inward. Two ring members 37 are disposed on the outer periphery of the first portion 13 of the insulator 11 so as to be apart from each other in the direction of the axial line O. The ring members 37 are disposed on the radially inner side of the tool engagement portion 34 of the metal shell 30, and a space enclosed by the ring members 37, the first portion 13, and the tool engagement portion 34 is filled with powder 38 such as talc. The to-be-engaged portion 35 is engaged with a rear end portion of the engagement portion 14 of the insulator 11 via the ring members 37 and the powder 38.

The metal shell 30 is formed such that the to-be-engaged portion 35 is bent inward so as to be engaged with the engagement portion 14 of the insulator 11, in a state where the ledge portion 32 is engaged with the diameter reduction portion 17 of the insulator 11. By the to-be-engaged portion 35 being bent, the metal shell 30 is crimped and fixed to the insulator 11. The insulator 11 is held by the metal shell 30 as a result of the engagement portion 14 and the diameter reduction portion 17 being sandwiched by the to-be-engaged portion 35 and the ledge portion 32 from both sides in the direction of the axial line O.

A ground electrode 40 is a member made from a metal (e.g., nickel-based alloy) and joined to the front end of the metal shell 30. In the present embodiment, the ground electrode 40 is formed in a rod shape, and has a front side bent so as to be opposed to the center electrode 20. A spark gap is formed between the ground electrode 40 and the center electrode 20.

The spark plug 10 is manufactured by the following method, for example. The insulator 11 is made by baking a molded product that is obtained by molding raw material powder. First, raw material powder is prepared by blending: alumina that is a main component; and a compound including an element such as Si, Mg, Ca, or Ba and that forms a glass phase so as to function as a sintering additive. A hydrophilic binder such as polyvinyl alcohol and a solvent such as water are added to the raw material powder, and the hydrophilic binder, the solvent, and the raw material powder are mixed together, thereby preparing a slurry. The slurry is dried by a spray drying method or the like, thereby preparing a granulated substance. The obtained granulated substance is subjected to pressure molding or injection molding, thereby obtaining a molded product. The molded product is baked, thereby obtaining the insulator 11. The obtained insulator 11 is subjected to grinding.

In the grinding, the first portion 13 of the insulator 11 is fixed to a chuck (not shown). While the chuck is being rotated about the axial line O, the outer peripheral surfaces of the engagement portion 14, the second portion 15, the diameter reduction portion 17, and the third portion 16 are ground with use of a cutting tool or a grindstone (neither of them are shown). The allowance for the grinding is about 100 to 500 μm. By moving the cutting tool or the grindstone in the direction of the axial line O while the insulator 11 is being rotated about the axial line O, a projected and recessed portion 50 (see FIG. 2) is formed on the outer peripheral surfaces of the engagement portion 14, the second portion 15, the diameter reduction portion 17, and the third portion 16 so as to helically extend in the circumferential direction.

Then, the center electrode 20 is inserted in the axial hole 12 of the insulator 11. The center electrode 20 is disposed such that the front end thereof is exposed from the axial hole 12 to the outside. The metal terminal 21 is inserted in the axial hole 12 so that electrical conduction between the metal terminal 21 and the center electrode 20 is ensured, and thereafter, the metal shell 30 having the ground electrode 40 joined thereto in advance is assembled on the outer periphery of the insulator 11. The ground electrode 40 is bent so as to be opposed to the center electrode 20, thereby obtaining the spark plug 10.

Figure 2:
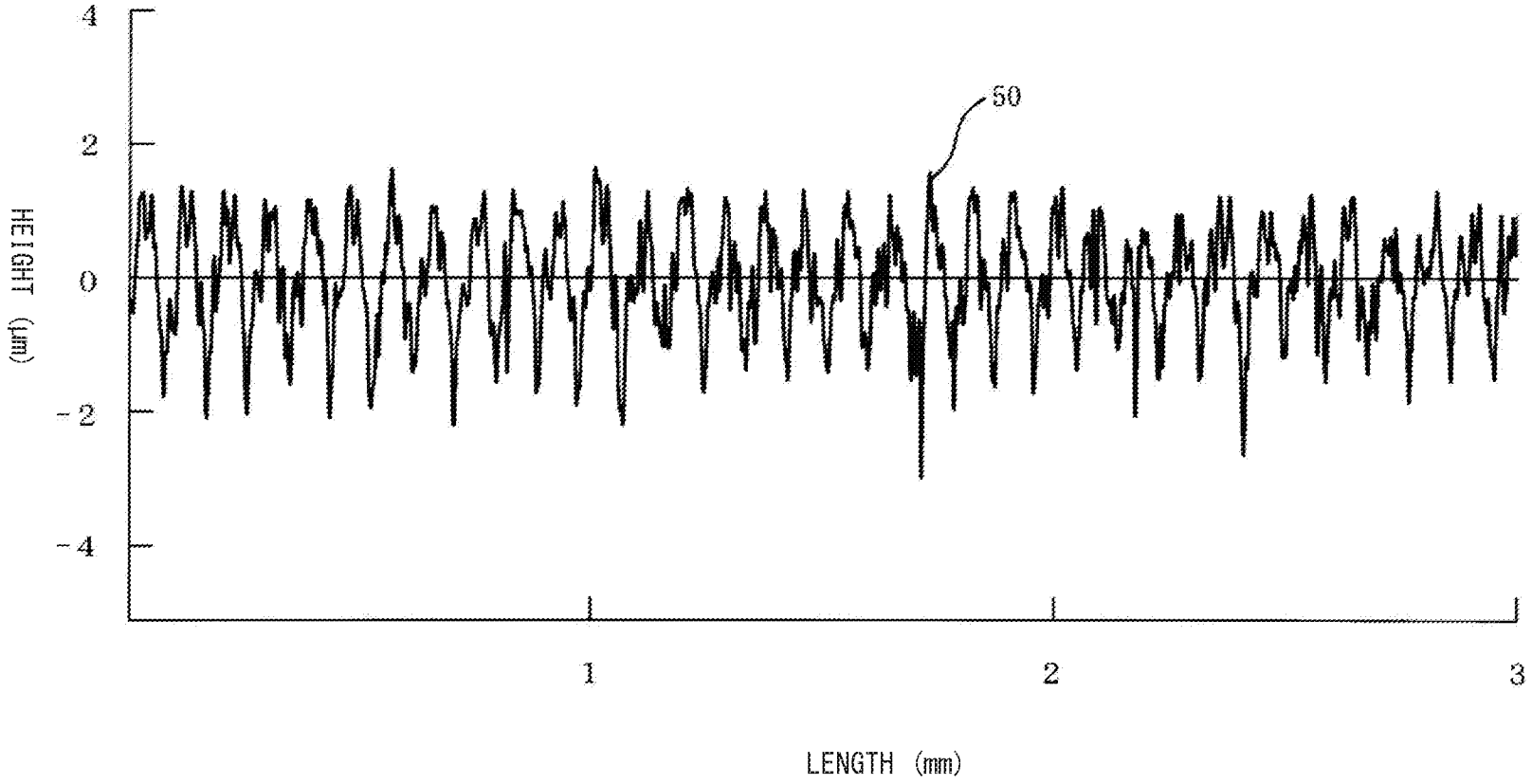
FIG. 2 is a profile curve of the actual surface of the outer peripheral surface of an insulator.

The shape of the outer peripheral surface of the insulator 11 will be described with reference to FIG. 2 to FIG. 5. FIG. 2 is a profile curve of the actual surface of the outer peripheral surface of the insulator 11, and indicates a contour of the projected and recessed portion 50 formed on the insulator 11. In FIG. 2, the horizontal axis indicates length in the direction of the axial line O, and the vertical axis indicates height. The profile curve of the actual surface is a curve that appears on a cross section obtained by cutting the outer peripheral surface of the insulator 11 along a plane including the axial line O (a curve based on measured values that are not cut off by a low-pass filter or a high-pass filter). The profile curve of the actual surface is measured with use of a contact-type surface roughness measuring machine on the basis of JIS B0601 (2013 edition).

FIG. 2 shows a profile curve of the actual surface of the second portion 15 of the insulator 11. The profile curve of the actual surface shown in FIG. 2 is a contour of the projected and recessed portion 50 at a portion thereof having a length of 4 mm in the direction of the axial line O. However, FIG. 2 shows the profile curve within a range of up to 3 mm. As is obvious from FIG. 2, the projected and recessed portion 50 of the insulator 11 is regularly formed. The profile curve of the actual surface is read as, for example, 32768 pieces of digital data, and amplitudes f(n) of frequencies n (where 1 Hz≤n≤300 Hz) are obtained through Fourier transform.

Figure 3:
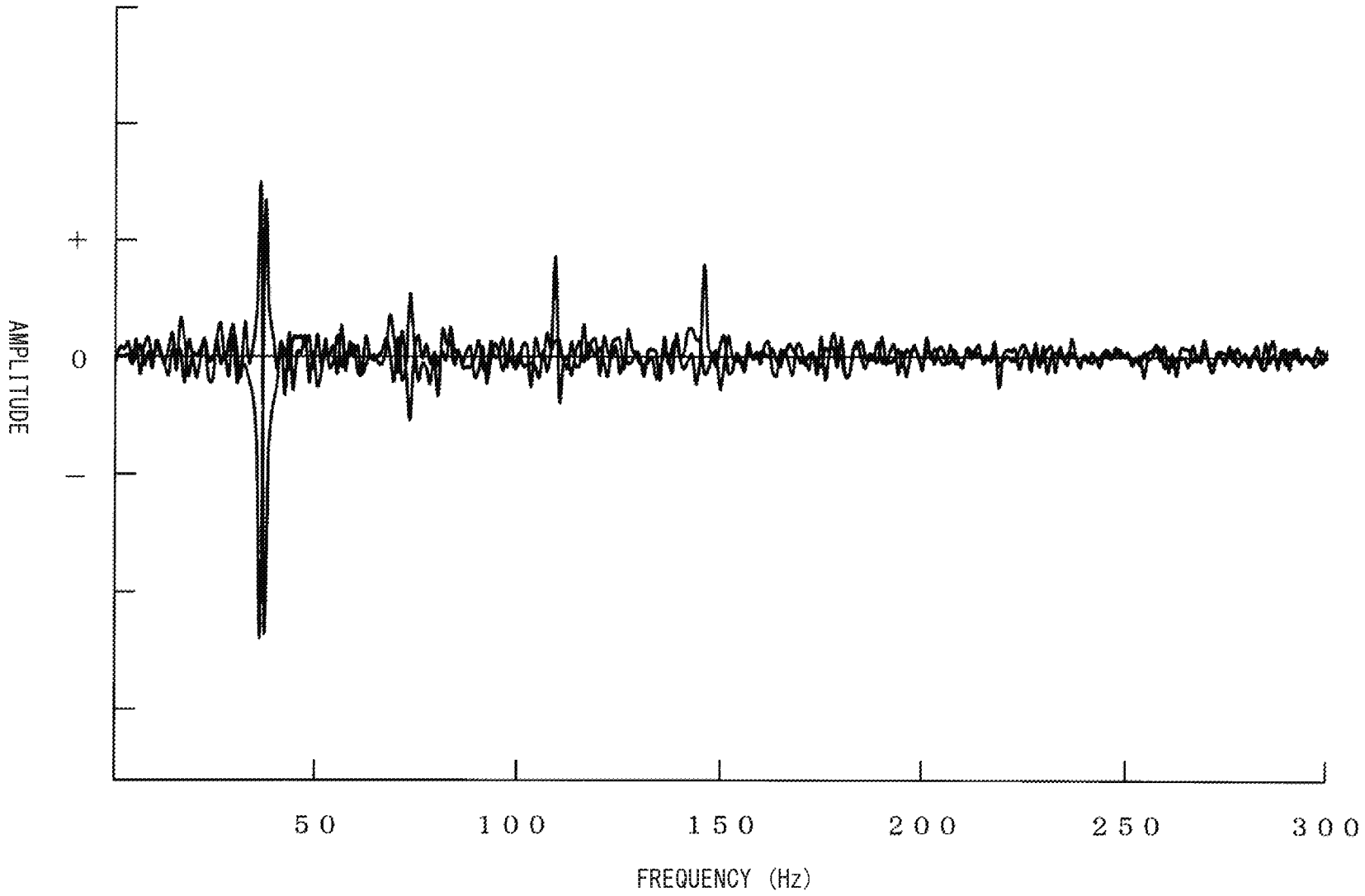
FIG. 3 is a spectrum obtained by performing Fourier transform on the profile curve of the actual surface.

FIG. 3 is a spectrum obtained by performing fast Fourier transform on the profile curve of the actual surface shown in FIG. 2. In FIG. 3, the horizontal axis indicates frequency, and the vertical axis indicates amplitude. In the spectrum shown in FIG. 3, spectrum components of a real part and an imaginary part are present in a mixed manner. As shown in FIG. 3, frequencies having large amplitudes (peaks) are discretely present in the spectrum. That is, the projected and recessed portion 50 is a cyclic waveform (contour). In order to reduce variation in a base line of the spectrum, f(n+1)−f(n) is calculated for the amplitudes f(n) of the frequencies n. Since the spectrum components are of the real part and the imaginary part, the calculation is performed for the real part and the imaginary part separately, and the absolute values are obtained.

Figure 4:
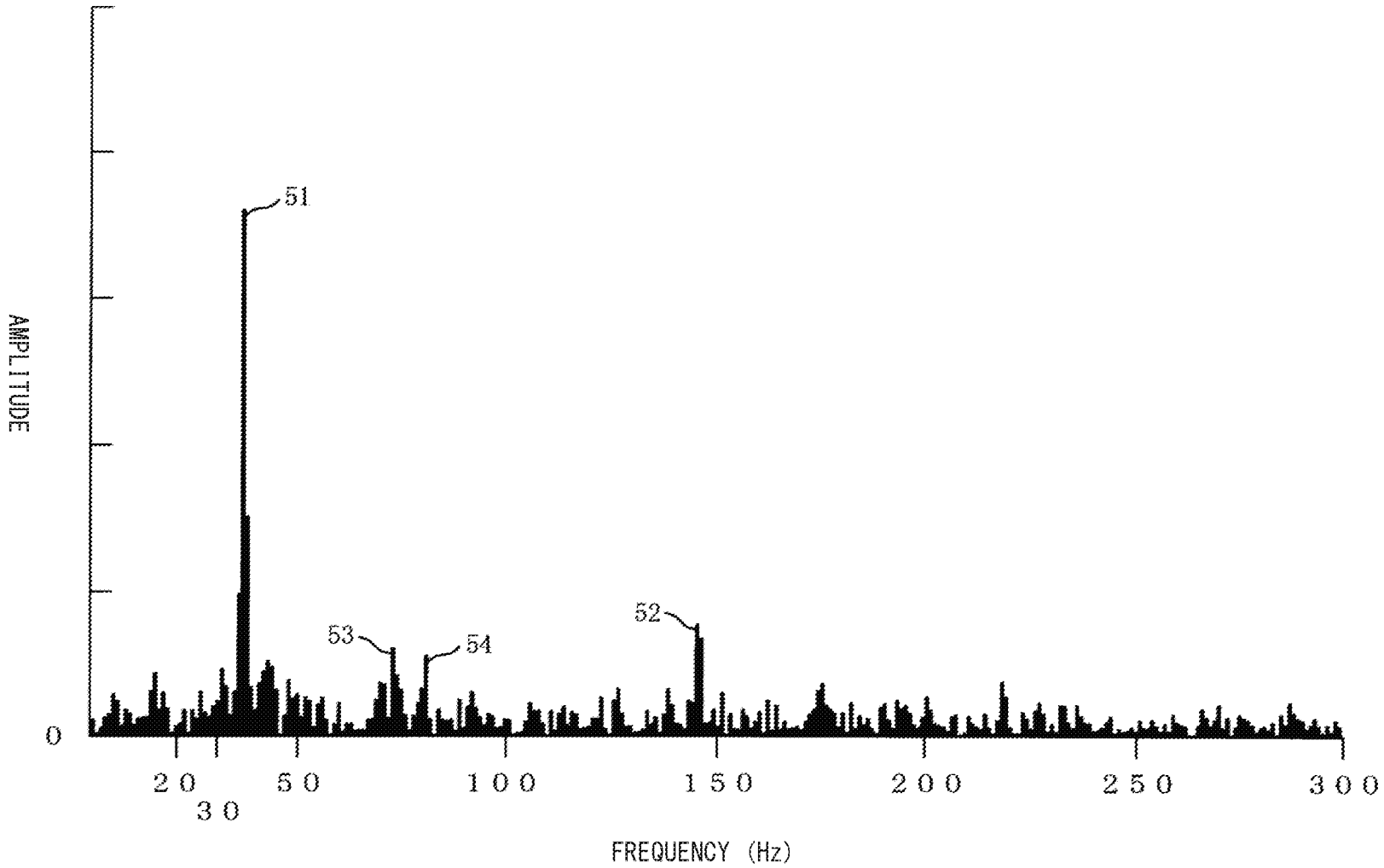
FIG. 4 is the result of obtaining absolute values of f(n+1)−f(n) of a real part.
Figure 5:
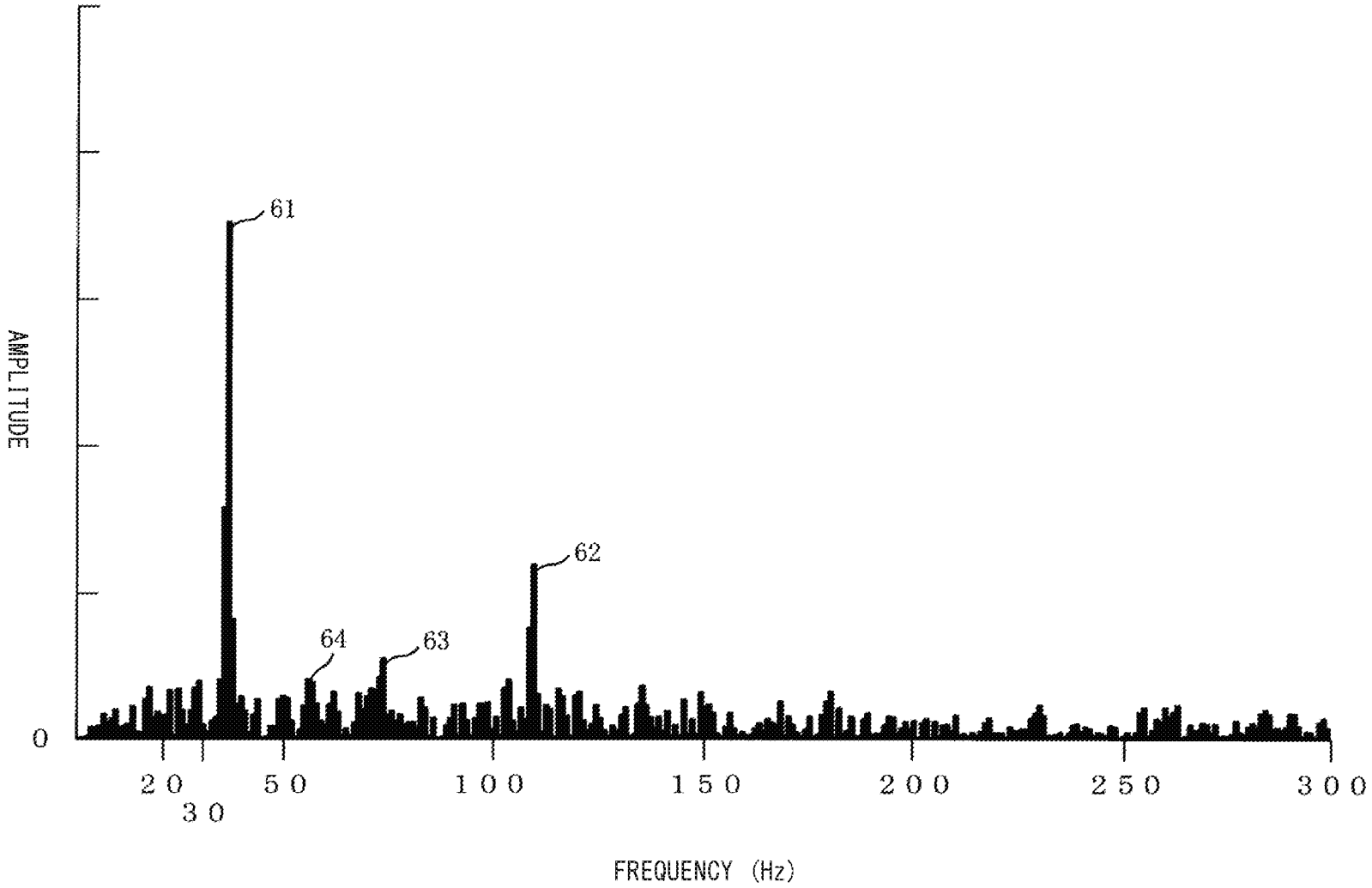
FIG. 5 is the result of obtaining absolute values of f(n+1)−f(n) of an imaginary part.

FIG. 4 is a result of obtaining the absolute values of f(n+1)−f(n) of the real part, and FIG. 5 is a result of obtaining the absolute values of f(n+1)−f(n) of the imaginary part. In FIG. 4, peaks are defined as a first peak 51, a second peak 52, a third peak 53, and a fourth peak 54 in descending order of the absolute value. Similarly, in FIG. 5, peaks are defined as a first peak 61, a second peak 62, a third peak 63, and a fourth peak 64 in descending order of the absolute value.

Here, when the first peaks 51, 61 to the fourth peaks 54, 64 are obtained, two or more peaks that are present within ±2 Hz are regarded as one peak. This is to prevent erroneous detection of a peak dependent on a sampling frequency (a reciprocal of the number of pieces of data as which the profile curve of the actual surface has been read), since the number of peaks that are present within ±2 Hz increases as the sampling frequency becomes higher so that the number of pieces of data becomes more.

As shown in FIG. 4 and FIG. 5, the first peaks 51, 61 are present within 20 to 300 Hz, and two or more peaks among the first peaks 51, 61, the second peaks 52, 62, the third peaks 53, 63, and the fourth peaks 54, 64 are present within 30 to 300 Hz. Three or more peaks among the first peaks 51, 61, the second peaks 52, 62, the third peaks 53, 63, and the fourth peaks 54, 64 are not present within 1 to 20 Hz.

Figure 6:
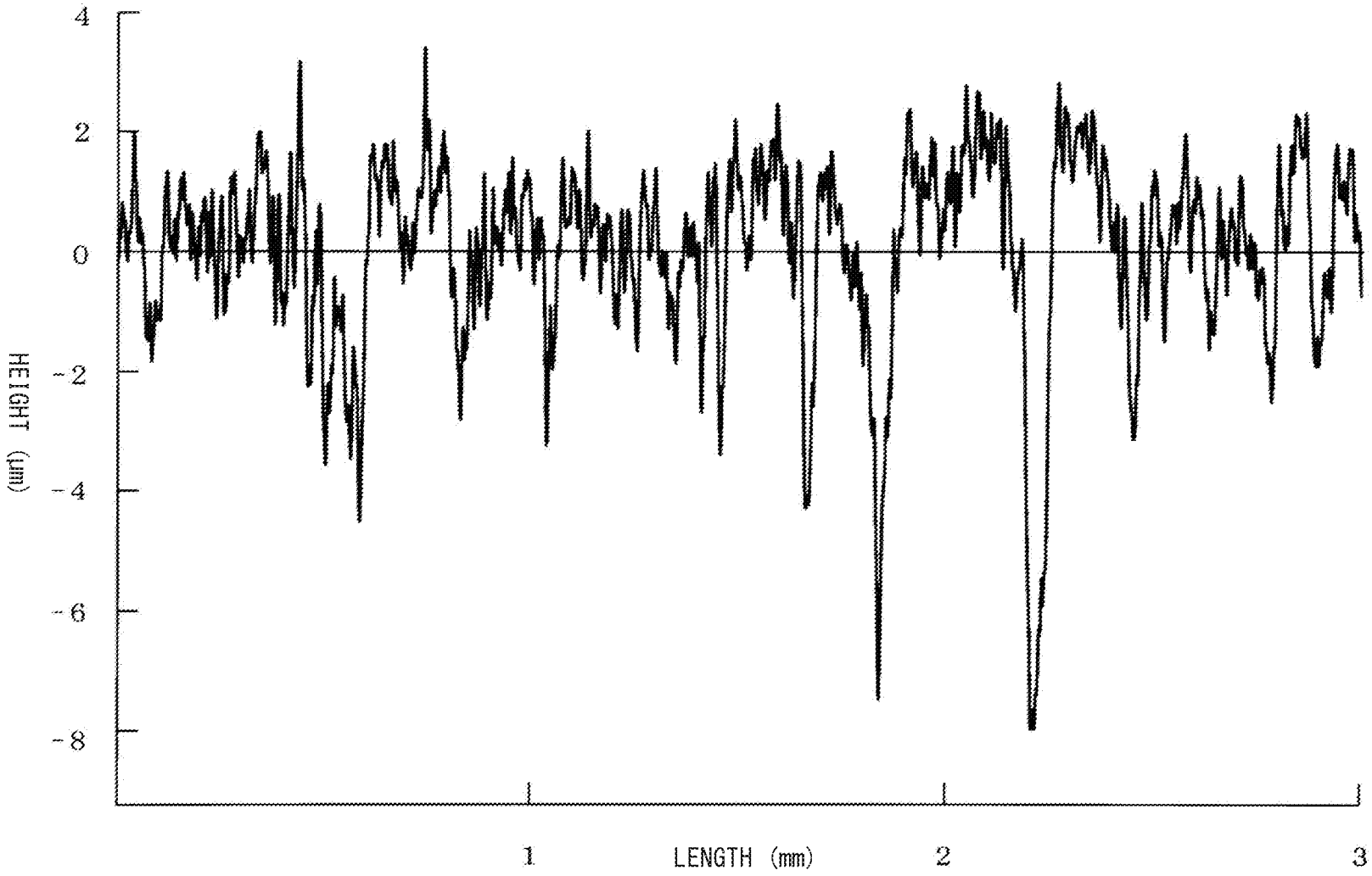
FIG. 6 is a profile curve of the actual surface of the outer peripheral surface of an insulator of a comparative example.

On the other hand, a profile curve of the actual surface of an insulator not subjected to grinding (hereinafter, referred to as an "insulator of a comparative example") is shown in FIG. 6. In FIG. 6, the horizontal axis indicates length in the direction of the axial line O, and the vertical axis indicates height. The profile curve of the actual surface shown in FIG. 6 is a contour of a portion having a length of 4 mm in the direction of the axial line O. However, FIG. 6 shows a profile curve within a range of up to 3 mm. The profile curve of the actual surface is read as, for example, 32768 pieces of digital data, and amplitudes f(n) of frequencies n (where 1 Hz≤n≤300 Hz) are obtained through Fourier transform.

Figure 7:
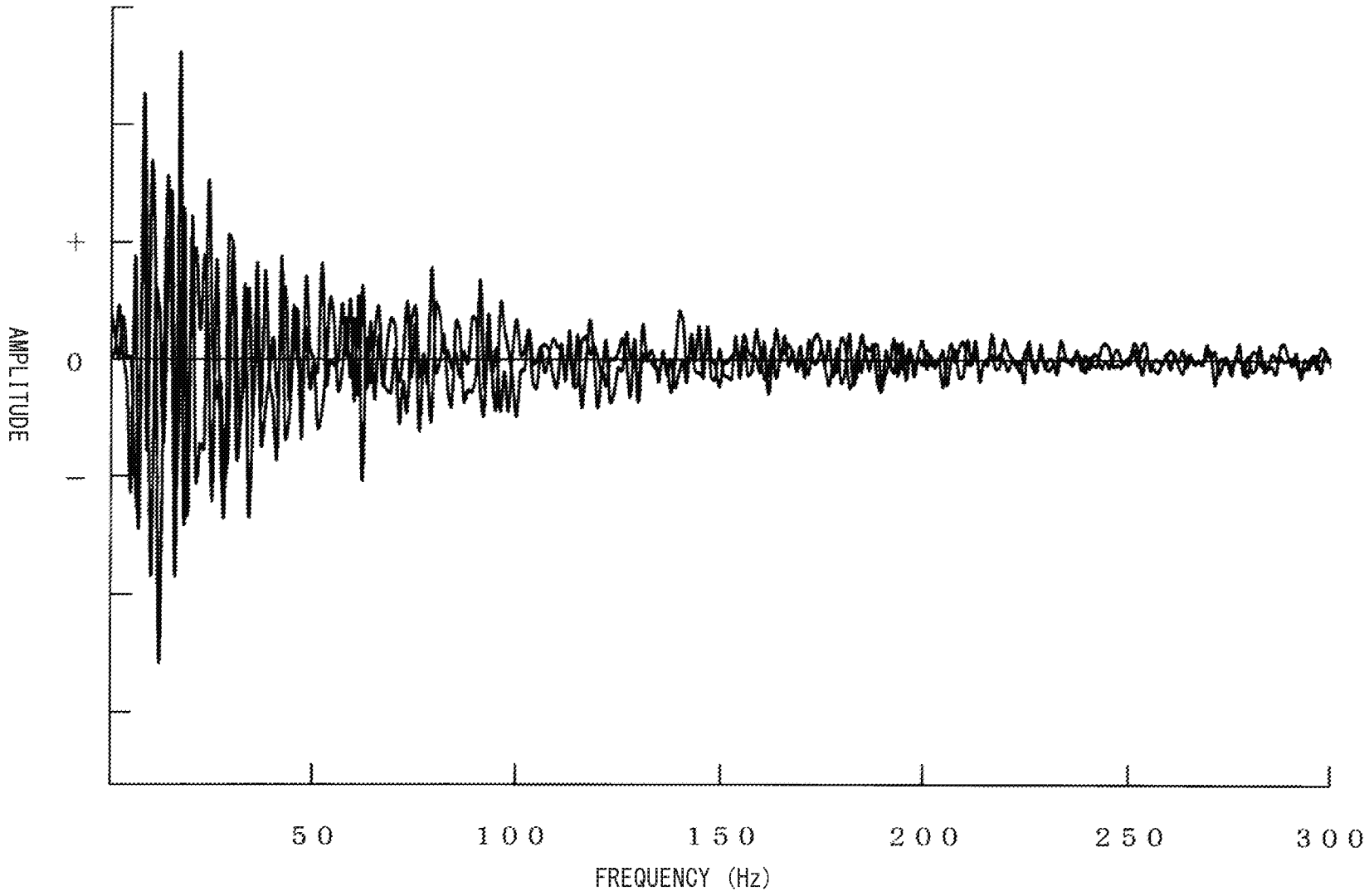
FIG. 7 is a spectrum obtained by performing Fourier transform on the profile curve of the actual surface.
Figure 8:
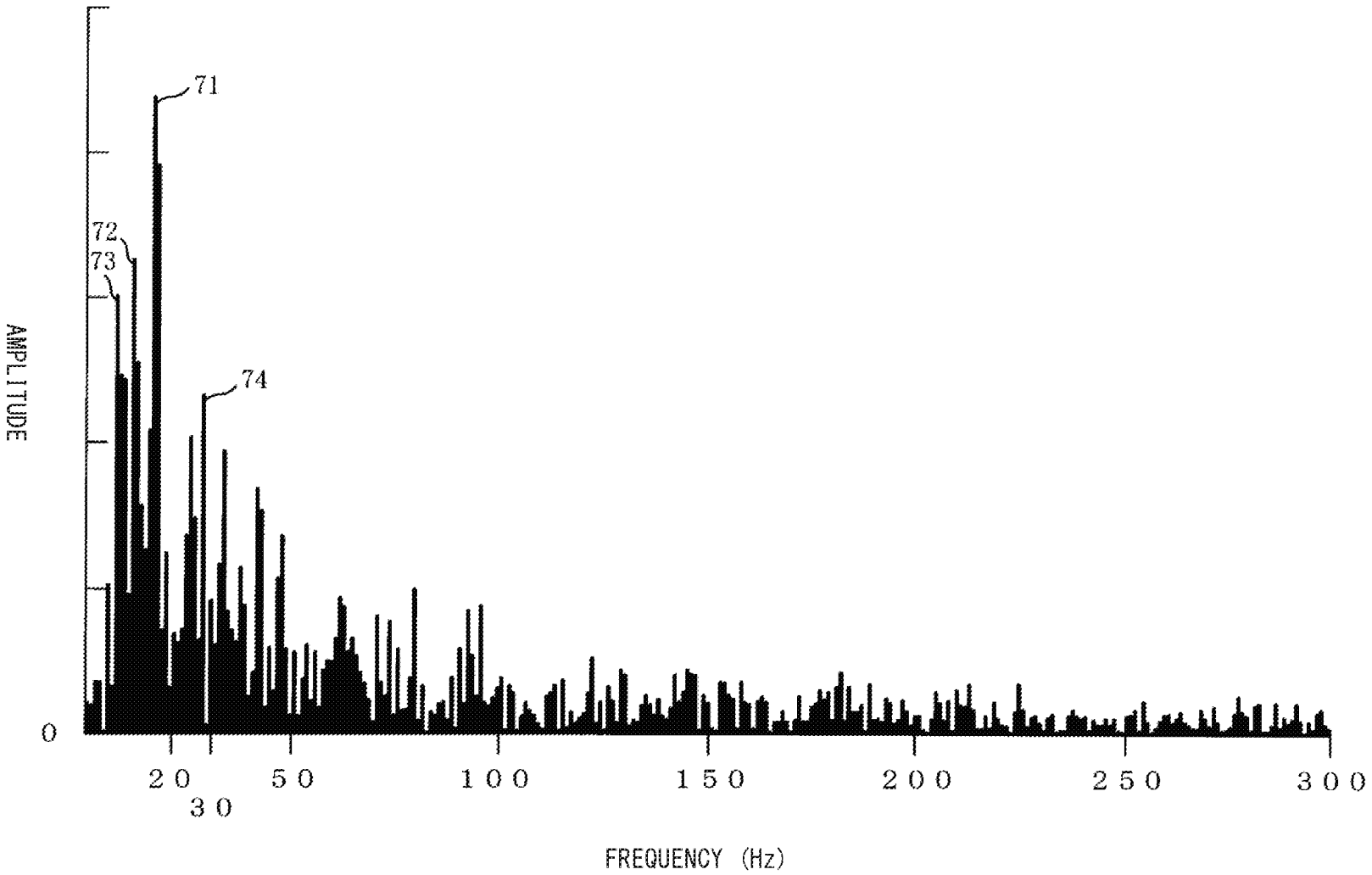
FIG. 8 is a result of obtaining absolute values of f(n+1)−f(n) of a real part.

FIG. 7 is a spectrum obtained by performing fast Fourier transform on the profile curve of the actual surface shown in FIG. 6. In FIG. 7, the horizontal axis indicates frequency, and the vertical axis indicates amplitude. In the spectrum shown in FIG. 7, spectrum components of a real part and an imaginary part are present in a mixed manner. In order to reduce variation in a base line of the spectrum, f(n+1)−f(n) is calculated for the amplitudes f(n) of the frequencies n. FIG. 8 is a result of obtaining the absolute values of f(n+1)−f(n) of the real part, and FIG. 9 is a result of obtaining the absolute values of f(n+1)−f(n) of the imaginary part.

In FIG. 8, peaks are defined as a first peak 71, a second peak 72, a third peak 73, and a fourth peak 74 in descending order of the absolute value. In FIG. 9, peaks are defined as a first peak 71, a second peak 72, a third peak 73, a fourth peak 74 in descending order of the absolute value. When the first peaks 71, 81 to the fourth peaks 74, 84 are obtained, two or more peaks that are present within ±2 Hz are regarded as one peak.

Figure 9:
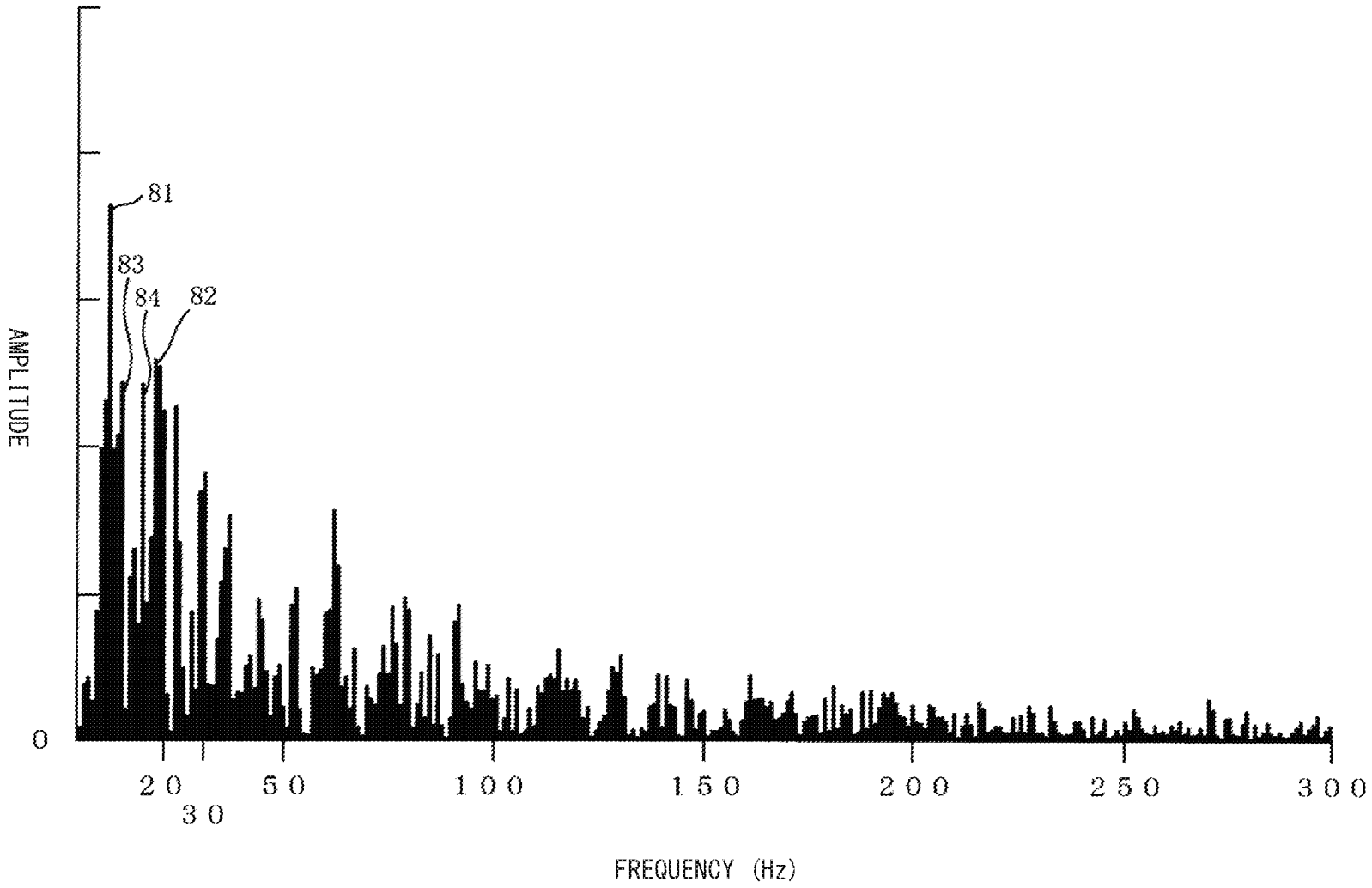
FIG. 9 is a result of obtaining absolute values of f(n+1)−f(n) of an imaginary part.

As shown in FIG. 8 and FIG. 9, the first peaks 71, 81 are present within 1 to 20 Hz, and three or more peaks among the first peaks 71, 81, the second peaks 72, 82, the third peaks 73, 83, and the fourth peaks 74, 84 are present within 1 to 20 Hz.

As described above, in the projected and recessed portion 50 of the insulator 11, the number of peaks in a range of low frequencies of 1 to 20 Hz is small and the number of peaks in a range of high frequencies higher than the low frequencies is large, and thus moisture or the like (moisture (condensate or the like) or fuel) put on the surface of the insulator 11 can be thinly spread along the projected and recessed portion 50. Since the projected and recessed portion 50 helically extends in the circumferential direction, the moisture or the like can be spread along the helix of the projected and recessed portion 50 in the circumferential direction and the axial direction even if the amount of the moisture or the like put on the surface of the insulator 11 is large. As a result, the moisture or the like having been thinly spread on the outer peripheral surface of the insulator 11 can be made easy to vaporize before reacting with a glass phase at a grain boundary of the ceramic from which the insulator 11 is made, whereby it is possible to suppress reduction in the strength of the insulator 11 due to degradation of the glass phase.

On the other hand, if, as in the insulator of the comparative example, the number of peaks in a range of low frequencies of 1 to 20 Hz is large and the number of peaks in a range of high frequencies higher than the low frequencies is small in the contour of the surface, large and small droplets of the moisture or the like put on the surface of the insulator are less likely to be changed in shape, and thus are not thinly spread on the outer peripheral surface of the insulator 11. Accordingly, the droplets of the moisture or the like put on the surface of the insulator are less likely to vaporize, and thus there is a possibility that a glass phase at a grain boundary of the ceramic becomes easy to react with the moisture or the like. If a glass phase at a grain boundary of the ceramic reacts therewith and the glass phase is degraded, there is a risk that the strength of the insulator is reduced. However, with the spark plug 10 according to the present embodiment, this problem can be solved, whereby it is possible to suppress reduction in the strength of the insulator 11.

Here, fuel is highly likely to be put on the outer peripheral surface of the insulator 11 in an in-cylinder direct fuel injection type (an engine of which is a so-called direct-injection engine) widely employed in an engine to which means such as increase of compression ratio and supercharged downsizing are applied to improve thermal efficiency. There is a risk that electric discharge is made impossible if moisture or the like (particularly fuel) put on the surface of the insulator 11 drips to reach the front end of the center electrode 20 and the moisture or the like accumulates in the spark gap between the center electrode 20 and the ground electrode 40.

On the other hand, in the spark plug 10, the helical projected and recessed portion 50 is formed on the front side (including the engagement portion 14) relative to the engagement portion 14, and thus moisture or the like put on the surface of the insulator 11 can be made easy to vaporize owing to the projected and recessed portion 50 before the moisture or the like drips to reach the front end of the center electrode 20. Therefore, the moisture or the like is prevented from dripping to reach the front end of the center electrode 20, whereby electric discharge by the spark plug 10 can be prevented from being hindered.

In addition, since the outer peripheral surfaces of the engagement portion 14, the second portion 15, the diameter reduction portion 17, and the third portion 16 of the insulator 11 are ground (grinding marks are formed on the outer peripheral surfaces), the dimensional accuracy of the outer diameter of the insulator 11 can be improved and the eccentricity rate of the insulator 11 can be reduced. The accuracy of a clearance in the radial direction between the metal shell 30 and the insulator 11 can be improved so that the accuracy of the insulation distance therebetween in the radial direction can be improved, whereby abnormal electric discharge (electric discharge that occurs at a portion other than the spark gap) can be made less likely to occur even if the outer diameter of the spark plug 10 is reduced.

As described above, although the present invention has been described based on the embodiment, the present invention is not limited to the above-described embodiment at all. It can be easily understood that various modifications can be devised without departing from the gist of the present invention. For example, the number of data pieces of the profile curve of the actual surface is not limited to that in the above-described embodiment, but can be set as appropriate.

In the above-described embodiment, the case has been described where, regarding the peaks in the spectrum components of both the real part and the imaginary part, the first peaks 51, 61 are present within 20 to 300 Hz, two or more peaks among the first peaks 51, 61, the second peaks 52, 62, the third peaks 53, 63, and the fourth peaks 54, 64 are present within 30 to 300 Hz, and three or more peaks among the first peaks 51, 61, the second peaks 52, 62, the third peaks 53, 63, and the fourth peaks 54, 64 are not present within 1 to 20 Hz. However, the present invention is not limited thereto. The present invention can be implemented as long as the above-described conditions are satisfied in either the real part or the imaginary part. This is because the profile curve of the actual surface simultaneously includes the real part which is a cos-wave term, and the imaginary part which is a sin-wave term.

In the above-described embodiment, the case has been described where the projected and recessed portion 50 is formed on all of the outer peripheral surfaces of the engagement portion 14, the second portion 15, the diameter reduction portion 17, and the third portion 16. However, the present invention is not limited thereto. The present invention can be implemented as long as the projected and recessed portion 50 is formed on at least some of the outer peripheral surfaces of the engagement portion 14, the second portion 15, the diameter reduction portion 17, and the third portion 16. This is because, by the projected and recessed portion 50 being formed on at least some of the outer peripheral surfaces of the engagement portion 14, the second portion 15, the diameter reduction portion 17, and the third portion 16, moisture or the like can be spread along the projected and recessed portion and the moisture or the like can be made easy to vaporize, as compared to an insulator on which no projected and recessed portion 50 is present at all.

In the above-described embodiment, the case has been described where the to-be-engaged portion 35 of the metal shell 30 is engaged with the rear end portion of the engagement portion 14 of the insulator 11 via the ring members 37 and the powder 38. However, the present invention is not limited thereto. As a matter of course, the to-be-engaged portion 35 of the metal shell 30 may be engaged with the rear end portion of the engagement portion 14 of the insulator 11, with neither the ring members 37 nor the powder 38 being provided.

In the above-described embodiment, the spark plug 10 in which the ground electrode 40 is opposed to the front end of the center electrode 20, has been described, but the structure of the spark plug is not limited thereto. As a matter of course, the technique in the present embodiment may be applied to other spark plugs each including the insulator 11. Examples of the other spark plugs include: a spark plug in which the ground electrode 40 is opposed to a side surface of the center electrode 20; a multi-electrode spark plug in which a plurality of ground electrodes 40 are joined to the metal shell 30; a spark plug in which an annular ground electrode is disposed at the front end of a metal shell projecting in the axial direction relative to a center electrode; and a spark plug in which no ground electrode 40 is provided and a center electrode is covered with a tubular insulator having a bottom.

DESCRIPTION OF REFERENCE NUMERALS

10: spark plug
11: insulator
14: engagement portion
30: metal shell
35: to-be-engaged portion
50: projected and recessed portion
51, 61: first peak
52, 62: second peak
53, 63: third peak
54, 64: fourth peak
O: axial line Having described the invention, the following is claimed:

1. A spark plug comprising:

a tubular insulator having an outer peripheral surface on which an engagement portion is formed, the insulator extending along an axial line from a front side to a rear side; and a tubular metal shell disposed on the outer peripheral surface of the insulator, and including a to-be-engaged portion engaged with a rear end portion of the engagement portion, wherein, on at least a part of the outer peripheral surface of the insulator, a projected and recessed portion is formed on the front side relative to the engagement portion so as to helically extend in a circumferential direction of the insulator.

2. The spark plug according to claim 1, wherein, in the projected and recessed portion, when amplitudes f(n) of frequencies n within 1 to 300 Hz are obtained by performing Fourier transform on a profile curve, of an actual surface of the outer peripheral surface, that appears on a cross section of the insulator including the axial line, and peaks are defined as a first peak, a second peak, a third peak, and a fourth peak in descending order of an absolute value of f(n+1)−f(n) (however, two or more peaks thereamong that are present within ±2 Hz are regarded as one peak), the first peak is present within 20 to 300 Hz, two or more peaks among the first peak, the second peak, the third peak, and the fourth peak are present within 30 to 300

Hz, and three or more peaks among the first peak, the second peak, the third peak, and the fourth peak are not present within 1 to 20 Hz.

* * * * *